US006382937B1

(12) United States Patent
Rha et al.

(10) Patent No.: US 6,382,937 B1
(45) Date of Patent: May 7, 2002

(54) TUBE PUMP

(75) Inventors: Phil-chan Rha, 205-704 Dujeong 2-cha Daewoo APT Dujeong-Dong, Cheonan-city (KR), 330210; Nam-sik Joo, Cheonan (KR)

(73) Assignee: Phil-Chan Rha, Cheonan (KR)

( * ) Notice: Subject to any disclaimer, the term of this patent is extended or adjusted under 35 U.S.C. 154(b) by 0 days.

(21) Appl. No.: 09/676,982

(22) Filed: Oct. 2, 2000

(30) Foreign Application Priority Data

Oct. 7, 1999 (KR) ..... 1999-21543 U
Aug. 11, 2000 (KR) ..... 2000-46515

(51) Int. Cl.[7] ..... F04B 43/08
(52) U.S. Cl. ..... 417/474
(58) Field of Search ..... 417/474, 437, 417/477, 475, 476, 477.3–477.14, 478; 604/153

(56) References Cited

U.S. PATENT DOCUMENTS 4,869,646 A * 9/1989 Gordon et al. ..... 417/18
4,906,229 A * 3/1990 Wampler ..... 600/16
5,083,908 A * 1/1992 Gagnebin et al. ..... 417/477
5,165,873 A * 11/1992 Meijer ..... 417/474
5,211,548 A * 5/1993 Okada ..... 417/474
5,290,158 A * 3/1994 Okada ..... 417/474
5,433,588 A * 7/1995 Monk et al. ..... 417/477.2
5,657,000 A * 8/1997 Ellingboe ..... 340/608
5,924,852 A * 7/1999 Moubayed et al. ..... 417/474
5,964,583 A * 10/1999 Danby ..... 417/474
6,106,249 A * 8/2000 Barak ..... 417/474

* cited by examiner

*Primary Examiner*—Teresa Walberg
*Assistant Examiner*—Daniel Robinson
(74) *Attorney, Agent, or Firm*—Jacobson Holman, PLLC

(57) ABSTRACT

Disclosed is a tube pump. The tube pump comprises a driving shaft having a plurality of eccentric cams which are mounted to the driving shaft in a manner such that positions of top dead centers of the eccentric cams are sequentially lowered and then raised along a fluid flowing direction, the plurality of eccentric cams being spaced apart one from another by a predetermined distance; a fixed shaft positioned parallel to the driving shaft; a tube having an inner diameter which is larger than a diameter of the fixed shaft and surrounding the fixed shaft; and a plurality of actuation rods formed, at upper portions thereof, with a plurality of cam inserting holes into which the plurality of eccentric cams are respectively inserted and, at lower portions thereof, with a plurality of tube inserting slots through which the tube is inserted, the plurality of actuation rods being repeatedly raised and lowered in such a way as to be interlocked with rotation of the plurality of eccentric cams.

7 Claims, 10 Drawing Sheets

[FIG 1]
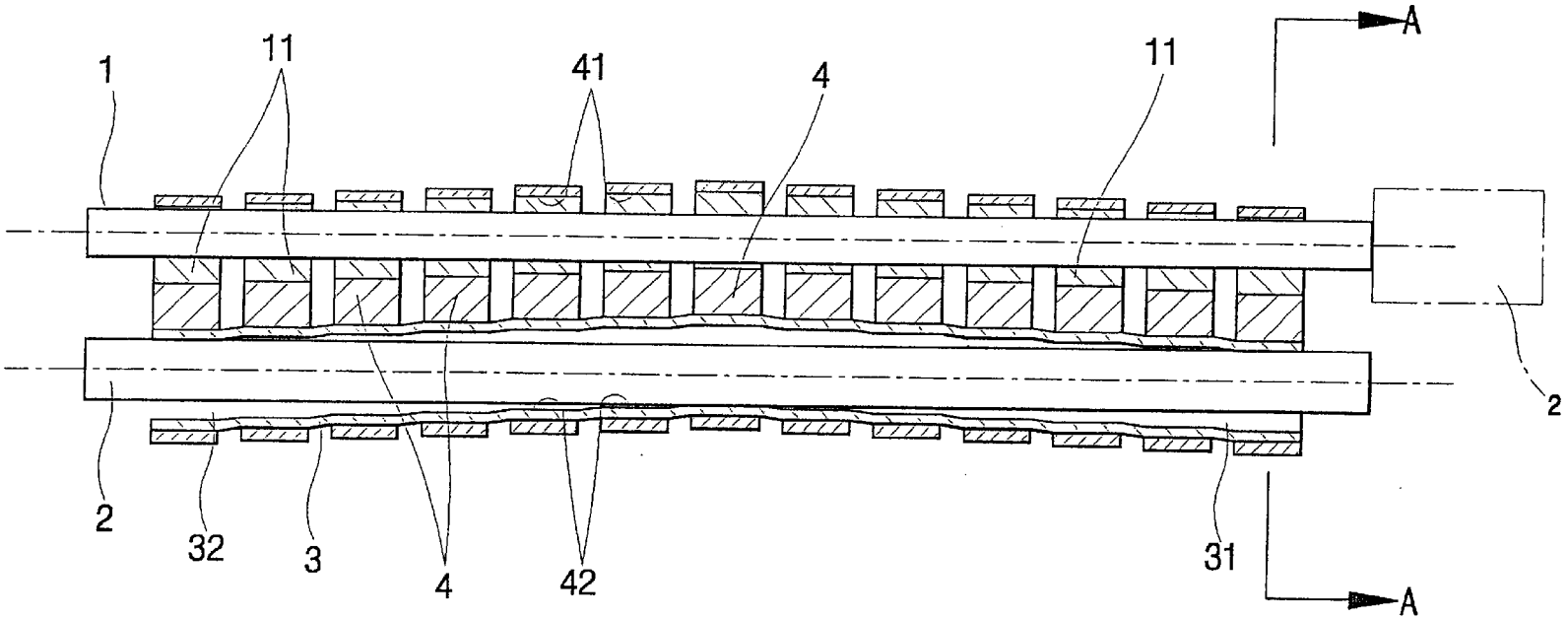

[FIG 2]
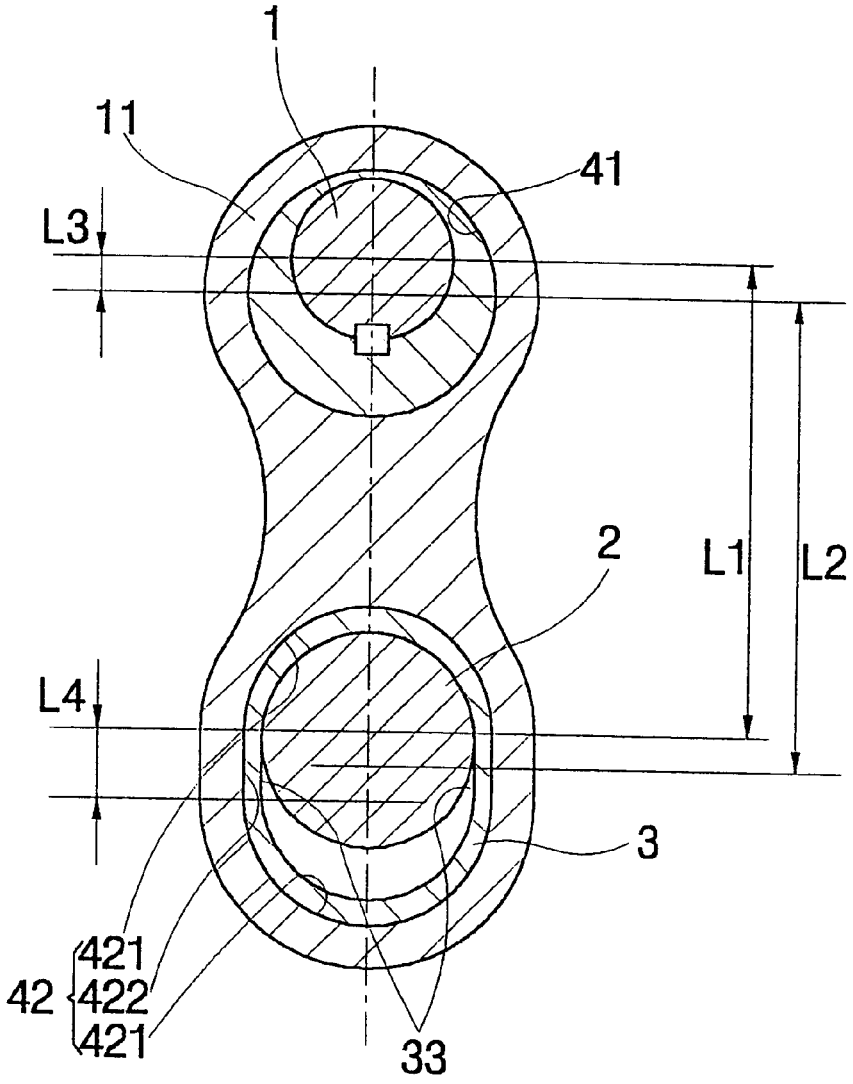

[FIG 3a]
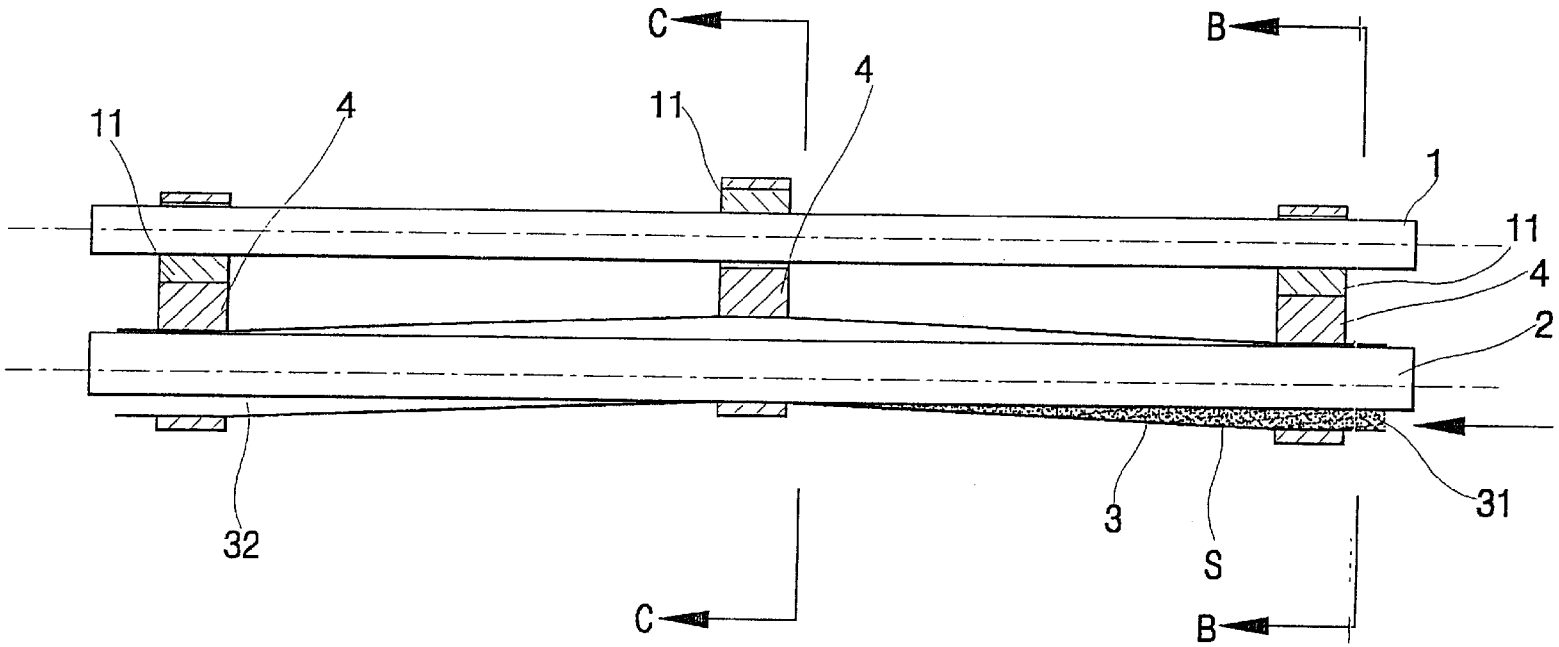

[FIG 3b]
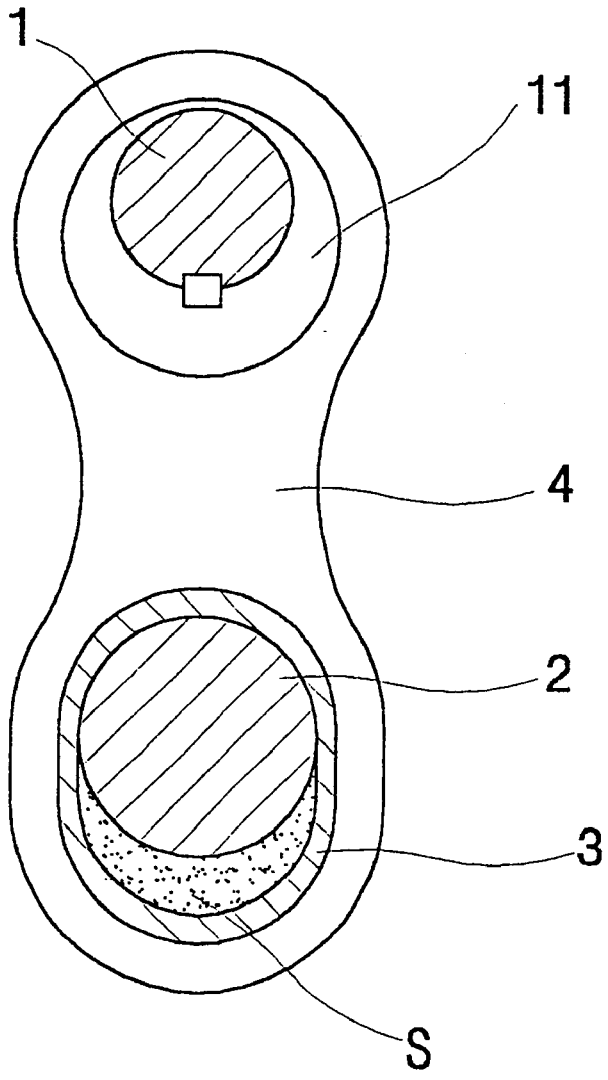

[FIG 3c]
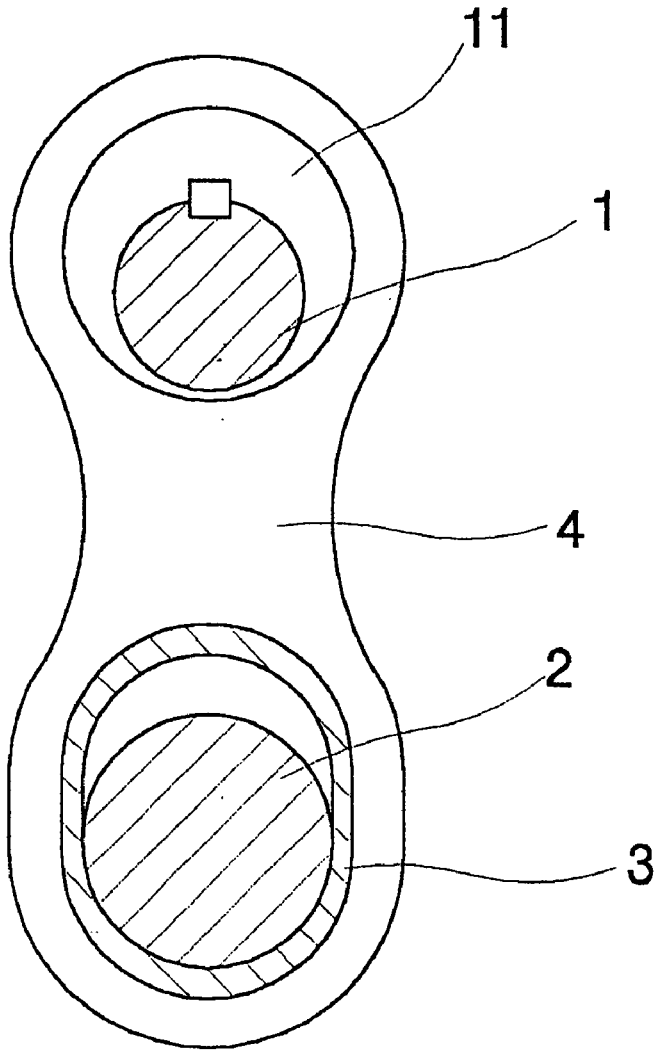

[FIG 4]
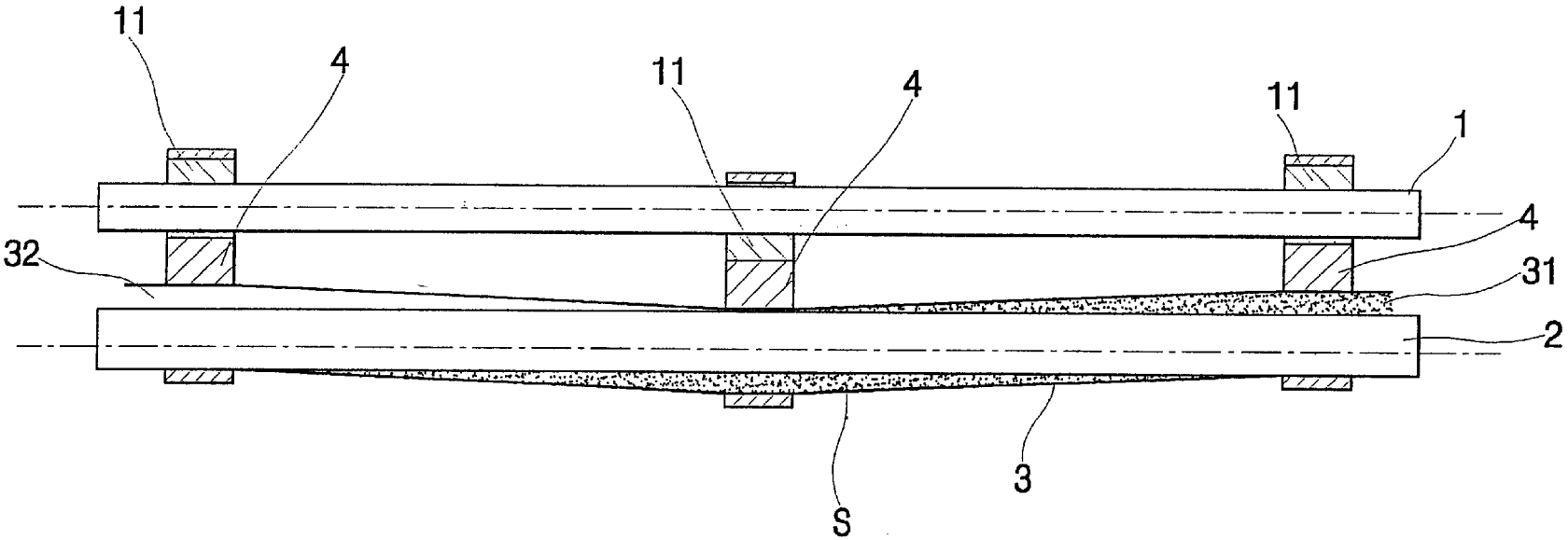

[FIG 5]
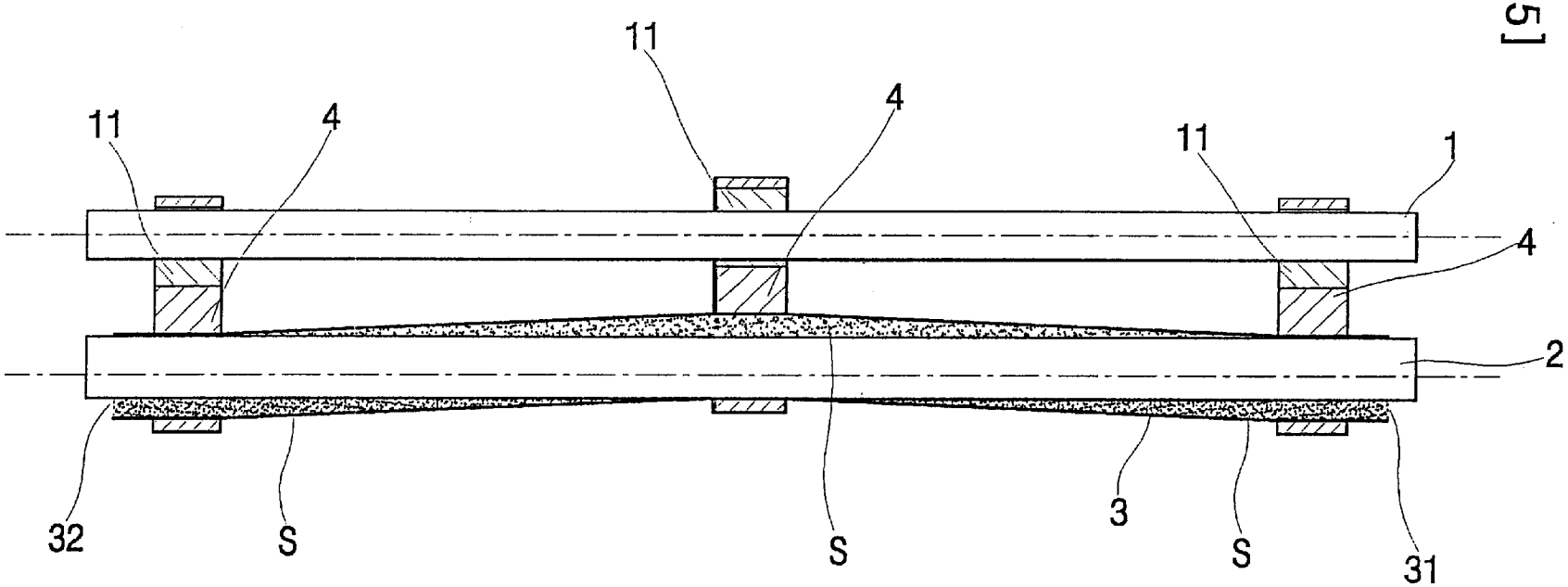

[FIG 6]
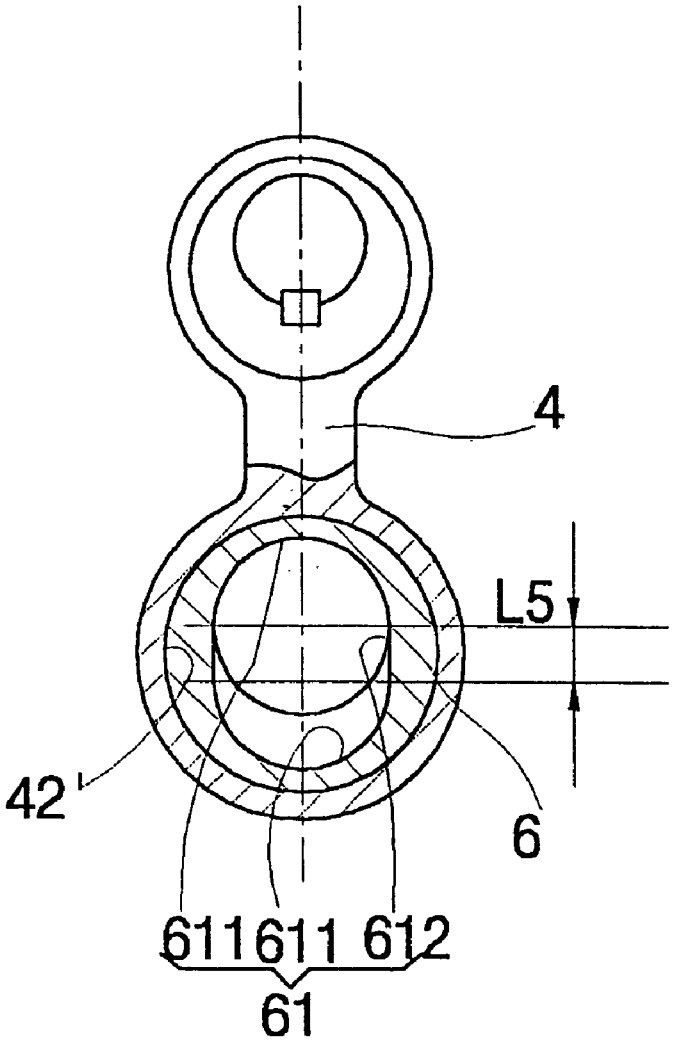

[FIG 7]
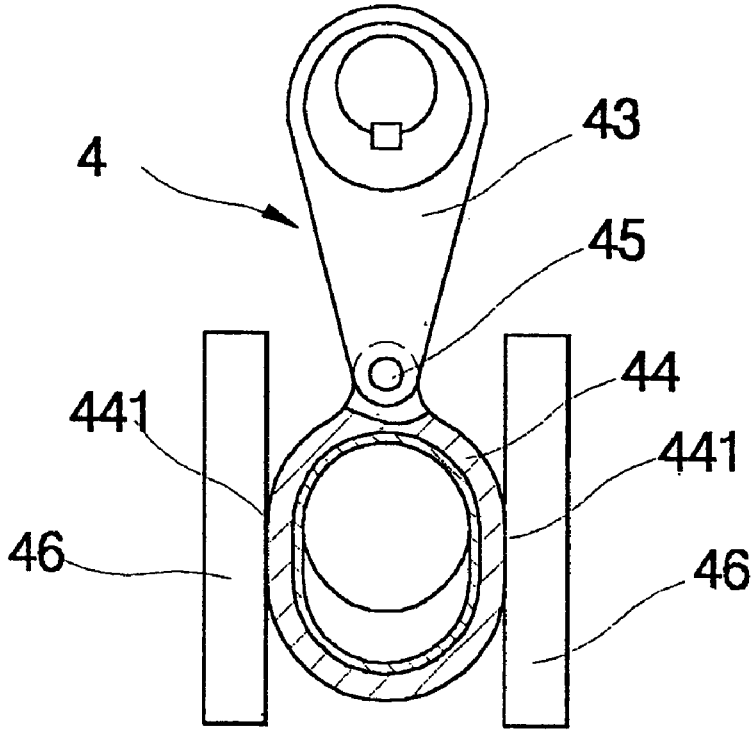

[FIG 8]
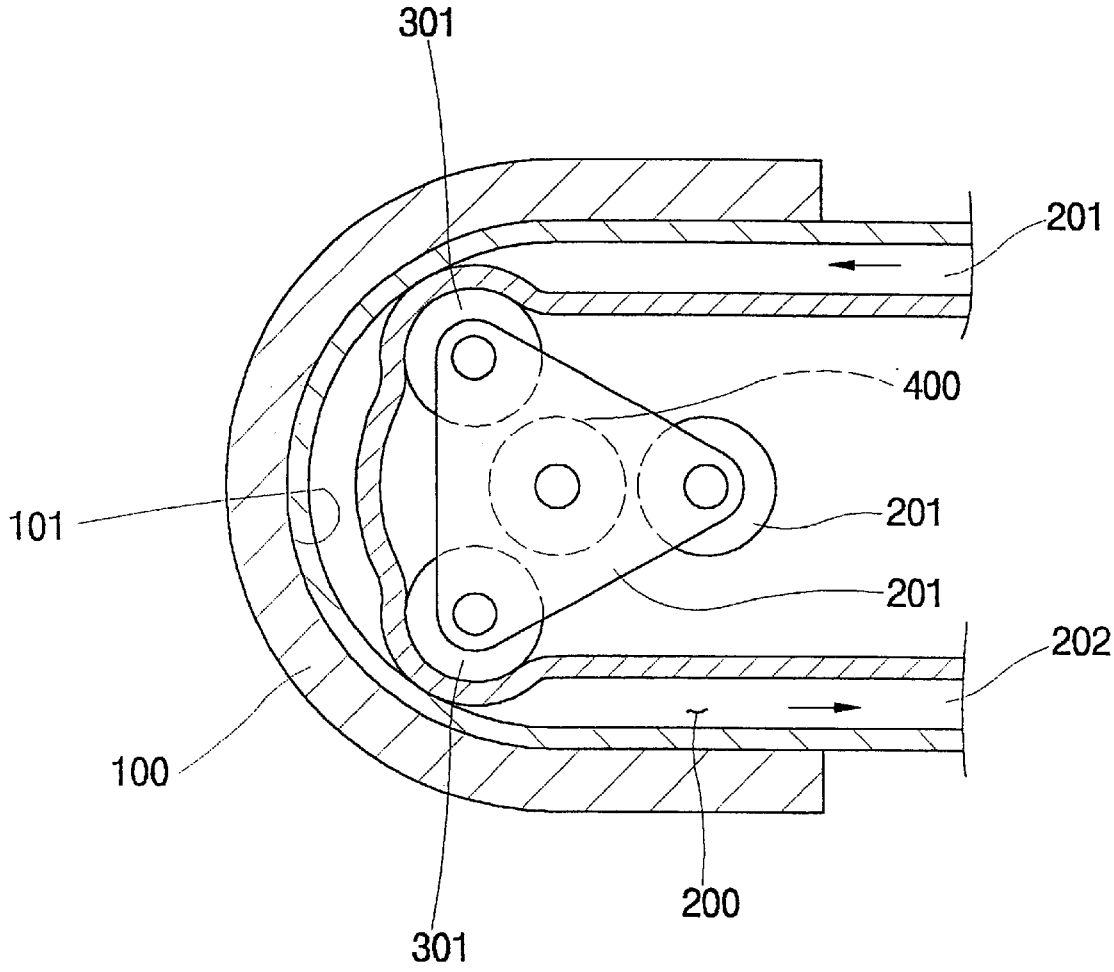
(Prior Art)

TUBE PUMP

TECHNICAL FIELD

The present invention relates to a tube pump, and more particularly, the present invention relates to a tube pump which does not cause bending or folding of a tube used for delivering fluid when the tube pump is actuated, thereby preventing the tube from being ruptured.

BACKGROUND ART

In general, a tube pump performs a function of delivering fluid by continuously changing a volume inside a tube. While a variety of tube pumps are disclosed in the art, a typical example of such tube pumps will be described hereinafter.

FIG. 8 is a cross-sectional view illustrating the conventional tube pump.

The conventional tube pump includes a housing 100, a tube 200, and a rotating bracket 300. The housing 100 has a semi-circular surface 101 which constitutes an inner surface of the housing 100. The tube 200 has an outer surface which is brought into line contact with the semi-circular surface 101 of the housing 100. The tube 200 is formed with an inlet port 201 through which fluid is intaken into the tube 200 and an outlet port 202 through which fluid is discharged out of the tube 200. The rotating bracket 300 is disposed at a center of curvature of the semi-circular surface 101 of the housing 100 and is rotated along the same locus as the semi-circular surface 101. The rotating bracket 300 has a plurality of squeezing rollers 301 which are respectively mounted to corner portions of the rotating bracket 300 so as to sequentially squeeze the tube 200 against the semi-circular surface 101 of the housing 100.

A driving section 400 for rotating the rotating bracket 300 is mounted to a center portion of the rotating bracket 300.

Accordingly, in the case that the tube pump is to be operated, as the driving section 400 which is mounted to the center portion of the rotating bracket 300, is actuated, the plurality of squeezing rollers 301 which are respectively mounted to the corner portions of the rotating bracket 300, repeatedly and sequentially squeeze the tube 200 against the semi-circular surface 101 of the housing 100, whereby fluid which is intaken through the inlet port 201 into the tube 200, can be delivered toward the outlet port 202.

However, the conventional tube pump constructed as mentioned above suffers from defects in that, since the tube 200 is sequentially and repeatedly squeezed against the semi-circular surface 101 of the housing 100 by the plurality of squeezing rollers 301 thereby to compress the fluid inside the tube 200, if the tube pump is used for a lengthy period of time, the tube 200 can be ruptured.

Also, the conventional tube pump is encountered with a problem in that a costly tube which have sufficiently high flexibility and elasticity, must be used as the tube 200 so as to enable the tube 200 to be easily returned to its original shape.

DISCLOSURE OF THE INVENTION

Accordingly, the present invention has been made in an effort to solve the problems occurring in the related art, and an object of the present invention is to provide a tube pump which delivers fluid by repeatedly and continuously creating and obliterating fluid chambers inside a tube surrounding a fixed shaft in such a way as not to cause bending or folding of the tube while the tube pump is actuated, thereby preventing the tube from being ruptured.

Another object of the present invention is to provide a tube pump in which a tube is disposed in such a way as to define substantially a linear contour, thereby enabling an inexpensive tube having not so high flexibility and elasticity to be used.

Still another object of the present invention is to provide a tube pump wherein a fluid flowing cross-sectional area, that is, a cross-sectional area change at any point along a fixed shaft over and under which upper and lower fluid chambers are repeatedly created in a tube in a manner such that the upper and lower fluid chambers are partitioned from each other by the fixed shaft, is always held constant, thereby preventing pulsation from being generated.

In order to achieve the above objects, according to one aspect of the present invention, there is provided a tube pump comprising: a driving shaft having a plurality of eccentric cams which are mounted to the driving shaft in a manner such that positions of top dead centers of the eccentric cams are sequentially lowered and then raised along a fluid flowing direction, the plurality of eccentric cams being spaced apart one from another by a predetermined distance; a fixed shaft positioned parallel to the driving shaft; a tube having an inner diameter which is larger than a diameter of the fixed shaft and surrounding the fixed shaft; and a plurality of actuation rods formed, at upper portions thereof, with a plurality of cam inserting holes into which the plurality of eccentric cams are respectively inserted and, at lower portions thereof, with a plurality of tube inserting slots through which the tube is inserted, the plurality of actuation rods being repeatedly raised and lowered in such a way as to be interlocked with rotation of the plurality of eccentric cams.

According to another aspect of the present invention, an inner surface of each actuation rod which inner surface defines the tube inserting slot, comprises upper and lower semi-circular surface portions and a pair of plane surface portions which connect both ends of the upper and lower semi-circular surface portions, and the fixed shaft always forces portions of the tube inserted through the tube inserting slot, to be respectively brought into tight contact with the pair of plane surface portions of the inner surface of each actuation rod, whereby a space inside the tube is divided into upper and lower space parts by the fixed shaft.

According to another aspect of the present invention, a distance between centers of the driving shaft and the fixed shaft is determined to be the same as that between centers of the cam inserting hole and the tube inserting slot, and a distance between centers of the upper and lower semi-circular surface portions of the inner surface of each actuation rod is determined to be smaller than two times of an eccentric distance of each eccentric cam in consideration of a percentage of contraction or expansion of the tube.

According to another aspect of the present invention, a bearing is intervened between a circumferential outer surface of the eccentric cam and a circumferential inner surface of each actuation rod, which defines the cam inserting hole, to reduce friction therebetween.

According to another aspect of the present invention, the tube inserting slots of the actuation rods are formed as circular tube inserting holes, and a tube having a circumferential outer surface which possesses a circular cross-section and an inner surface which defines a slot, is inserted through the circular tube inserting holes of the actuation rods.

According to still another aspect of the present invention, the inner surface of the tube which inner surface defines the slot, comprises upper and lower semi-circular surface portions and a pair of plane surface portions which connect both ends of the upper and lower semi-circular surface portions, and the fixed shaft always forces portions of the tube inserted through the circular tube inserting holes of the actuation rods, to be respectively brought into tight contact with portions of each actuation rod, at the pair of plane surface portions, whereby a space inside the tube is divided into upper and lower space parts by the fixed shaft.

According to yet still another aspect of the present invention, each actuation rod has a cam mounting section and a tube mounting section which are connected with each other by a hinge member, the tube mounting section of each actuation rod is formed with a pair of plane surface portions, and a pair of vertical guides are disposed at sides of the plane surface portions of the actuation rods to enable the tube mounting sections of the actuation rods to be raised and lowered along a vertical direction.

BRIEF DESCRIPTION OF THE DRAWINGS

The above objects, and other features and advantages of the present invention will become more apparent after a reading of the following detailed description when taken in conjunction with the drawings, in which:

FIG. 1 is a front cross-sectional view illustrating an entire construction of a tube pump in accordance with an embodiment of the present invention;

FIG. 2 is a side cross-sectional view taken along the line A—A of FIG. 1;

FIGS. 3*a* through 3*c* illustrate an intaking procedure of the tube pump according to the present invention, wherein FIG. 3*a* is a front cross-sectional view, FIG. 3*b* is a side cross-sectional view taken along the line B—B of FIG. 3*a*, and FIG. 3*c* is a side cross-sectional view taken along the line C—C of FIG. 3*a;*

FIG. 4 is a front cross-sectional view illustrating an initial discharging procedure of the tube pump according to the present invention;

FIG. 5 is a front cross-sectional view illustrating a final discharging procedure of the tube pump according to the present invention;

FIG. 6 is a side cross-sectional view illustrating a tube pump in accordance with another embodiment of the present invention;

FIG. 7 is a side cross-sectional view illustrating a tube pump in accordance with still another embodiment of the present invention; and FIG. 8 is a cross-sectional view illustrating the conventional tube pump.

BEST MODE FOR CARRYING OUT THE INVENTION

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is a front cross-sectional view illustrating an entire construction of a tube pump in accordance with an embodiment of the present invention. The construction of the tube pump will be first described hereinbelow.

The tube pump according to the present invention includes a driving shaft 1, a fixed shaft 2, a tube 3 and a plurality of actuation rods 4. A plurality of eccentric cams 11 which have the same diameter and the same difference in eccentric distance between two adjoining eccentric cams 11, are mounted to the driving shaft 1 in a manner such that the plurality of eccentric cams 11 are spaced apart one from another by a predetermined distance. The fixed shaft 2 is positioned parallel to the driving shaft 1. The tube 3 surrounds the fixed shaft 2 along a lengthwise direction of the fixed shaft 2. The tube 3 is formed with an inlet port 31 through which fluid is intaken into the tube 3 and an outlet port 32 through which fluid is discharged out of the tube 3. The plurality of actuation rods 4 allow the plurality of eccentric cams 11 to be respectively inserted in upper portions thereof and the tube 3 to be inserted through lower portions thereof. The plurality of actuation rods 4 are actuated in such a way as to be interlocked with rotation of the plurality of eccentric cams 11.

Especially, the plurality of eccentric cams 11 are mounted to the driving shaft 1 in a manner such that positions of top dead centers of the eccentric cams 11 are sequentially lowered and then raised along a fluid flowing direction.

The tube 3 has an inner diameter which is larger than a diameter of the fixed shaft 2, by which the tube 3 is capable of performing a wavelike movement over and under the fixed shaft 2.

The plurality of actuation rods 4 are mounted to the plurality of eccentric cams 11 and the tube 3 in a manner such that the actuation rods 4 are repeatedly raised and lowered in such a way as to be interlocked with the rotation of the plurality of eccentric cams 11. Hence, as the tube 3 performs the wavelike movement over and under the fixed shaft 2 by virtue of the actuation rods 4, the fluid which is intaken through the inlet port 31 into the tube 3, can be delivered toward the outlet port 32.

This will be described in further detail hereinbelow.

FIG. 2 is a side cross-sectional view taken along the line A–A of FIG. 1. The upper portions of the actuation rods 4 are respectively formed with a plurality of cam inserting holes 41 each of which possesses a circular cross-section. Each cam inserting hole 41 has a diameter which is the same as a diameter of the eccentric cam 11. The eccentric cams 11 are respectively inserted into the cam inserting holes 41. The lower portions of the actuation rods 4 are respectively formed with a plurality of tube inserting slots 42.

In particular, an inner surface of each actuation rod 4 which inner surface defines the tube inserting slot 42, comprises upper and lower semi-circular surface portions 421 which are symmetrically formed with each other and a pair of plane surface portions 422 which connect both ends of the upper and lower semi-circular surface portions 421. The pair of plane surface portions 422 enable both sides of the tube 3 inserted into the tube inserting slot 42 to be flattened.

That is to say, as both sides of the tube 3 which is inserted into the tube inserting slot 42, are flattened, the fixed shaft 3 which is inserted into the tube 3, forces portions of the tube 3 to be respectively brought into tight contact with the pair of plane surface portions 422 of the inner surface of each actuation rod 4, whereby a space inside the tube 3 is always divided into upper and lower space parts by the fixed shaft 2.

Further, a bearing is intervened between a circumferential outer surface of each eccentric cam 11 and a circumferential inner surface of each actuation rod 4, which defines the cam inserting hole 41, to reduce friction therebetween.

Moreover, a distance L1 between centers of the driving shaft 1 and the fixed shaft 2 is determined to be the same as a distance L2 between centers of the cam inserting hole 41 and the tube inserting slot 42, and a distance L4 between centers of the upper and lower semi-circular surface portions 421 of the inner surface of each actuation rod 4 which inner surface defines the tube inserting slot 42, is determined to be smaller than two times of an eccentric distance L3 of each eccentric cam 11 in consideration of a percentage of contraction or expansion of the tube 3. Namely, in the case that the tube 3 repeatedly performs the wavelike movement over and under the fixed shaft 2, as shown in FIG. 1, fluid chambers S are repeatedly formed over and under the fixed shaft 2 in the tube 3, whereby fluid which is intaken into the tube 3 through the inlet port 31, is delivered toward the outlet port 32. Due to the fact that the distance L4 between centers of the upper and lower semi-circular surface portions 421 of the inner surface of each actuation rod 4 which inner surface defines the tube inserting slot 42, is determined to be smaller than two times of the eccentric distance L3 of each eccentric cam 11, since a circumferential outer surface of the fixed shaft 2 is brought into close contact with the tube 3, precision is maintained upon actuating the tube pump.

The drawing reference numeral 5 represents a driving section which is connected to the driving shaft 1.

Hereinafter, operations of the tube pump according to the present invention, constructed as mentioned above, will be described in detail.

Since the tube pump according to the present invention performs a function of delivering fluid by repeating an intaking procedure and a discharging procedure, descriptions hereinafter will be divisionally given in terms of the intaking procedure and the discharging procedure. Also, in the present invention, the tube pump can repeatedly and continuously implement two strokes, that is, an intaking stroke and a discharging stroke, due to the above-described arrangement of the plurality of eccentric cams 11. In this connection, the descriptions hereinafter will be given with respect to one intaking stroke and one discharging stroke.

First, in the intaking procedure as shown in FIGS. 3*a* through 3*c*, the actuation rod 4 which is mounted to the tube 3 adjacent to the inlet port 31, is placed at its lowermost position through the rotation of the eccentric cam 11. By this, as the fluid chamber S is created under the fixed shaft 2 inside the tube 3 which surrounds the fixed shaft 2, fluid is intaken into the tube 3 through the inlet port 31 from an external source.

In other words, the actuation rod 4 which adjoins the inlet port 31, is placed at the lowermost position by the rotation of the eccentric cam 11 which is mounted to the driving shaft 1. Therefore, as the upper semi-circular surface portion 421 which constitutes the inner surface of the actuation rod 4 which inner surface defines the tube inserting slot 42, and an upper half of the circumferential outer surface of the fixed shaft 2 are brought into close contact with each other, the fluid chamber S is created under the fixed shaft 2.

Also, in the intaking procedure, the actuation rod 4 which is located in the middle between the inlet port 31 and the outlet port 32 which are formed in the tube 3, is placed at its uppermost position. The actuation rod 4 which is mounted to the tube 3 adjacent to the outlet port 32, is placed at its lowermost position as in the actuation rod 4 which adjoins the inlet port 31.

Next, in an initial discharging procedure for compressing the fluid which is intaken into the tube 3 through the intaking procedure, as shown in FIG. 4, as the actuation rod 4 which is mounted to the tube 3 adjacent to the inlet port 31 is placed at its uppermost position through continuous rotation of the eccentric cam 11, the fluid chamber S which is created under the fixed shaft 2, is obliterated.

And, at the same time with this, the actuation rod 4 which is mounted to the middle of the tube 3, is placed at its lowermost position through interlocked rotation of the eccentric cams 11 which are mounted to the driving shaft 1. The actuation rod 4 which is mounted to the tube 3 adjacent to the outlet port 32, is placed at its uppermost position.

That is to say, as the eccentric cam 11 which is mounted to the driving shaft 1 and adjoins the inlet port 31, is rotated by an angle of 180° from the position shown in FIGS. 3*a* through 3*c* and places the corresponding actuation rod 4 at the uppermost position, the lower semi-circular surface portion 421 which constitutes the inner surface of the actuation rod 4 which inner surface defines the tube inserting slot 42, and a lower half of the circumferential outer surface of the fixed shaft 2 are brought into close contact with each other, whereby the fluid chamber S is created over the fixed shat 2 in the tube 3. Also, as the eccentric cam 11 which is mounted to the middle of the driving shaft 1, is also rotated by an angle of 180° from the position shown in FIGS. 3*a* through 3*c* and places the corresponding actuation rod 4 at the lowermost position, the upper semi-circular surface portion 421 which constitutes the inner surface of the actuation rod 4 which inner surface defines the tube inserting slot 42, and the upper half of the circumferential outer surface of the fixed shaft 2 are brought into close contact with each other, whereby the fluid chamber S is created under the fixed shaft 2 in the tube 3. Further, as the eccentric cam 11 which is mounted to the driving shaft 1 and adjoins the outlet port 32, is rotated by an angle of 180° from the position shown in FIGS. 3*a* through 3*c* and places the corresponding actuation rod 4 at the uppermost position in the same manner as the eccentric cam 11 which adjoins the inlet port 31, the lower semi-circular surface portion 421 which constitutes the inner surface of the actuation rod 4 which inner surface defines the tube inserting slot 42, and the lower half of the circumferential outer surface of the fixed shaft 2 are brought into close contact with each other, whereby the fluid chamber S is created over the fixed shaft 2 in the tube 3.

As a consequence, the fluid which is intaken into the tube 3 through the intaking procedure, flows into the fluid chamber S which is created under the fixed shaft 2 at the middle of the tube 3, and is compressed therein.

Finally, in a final discharging procedure for discharging the fluid which has undergone the initial discharging procedure, out of the tube 3, as shown in FIG. 5, as the actuation rod 4 which is mounted to the middle of the tube 3, is placed again at the uppermost position through continuous rotation of the corresponding eccentric cam 11, the fluid chamber S which is created under the fixed shaft 2, is obliterated.

And, at the same time with this, as the eccentric cam 11 which is mounted to the driving shaft 1 and adjoins the outlet port 32 is integrally rotated with the driving shaft 1, the actuation rod 4 which is mounted to the tube 3 adjacent to the outlet port 32, is placed again at its lowermost position.

Namely, as the eccentric cam 11 which is mounted to the middle of the driving shaft 1, is rotated again by an angle of 180° from the position shown in FIG. 4 and places again the corresponding actuation rod 4 at the uppermost position, the lower semi-circular surface portion 421 which constitutes the inner surface of the actuation rod 4 which inner surface defines the tube inserting slot 42, and the lower half of the circumferential outer surface of the fixed shaft 2, are brought into close contact with each other, whereby the fluid chamber S is created over the fixed shaft 2 in the tube 3. Also, as the eccentric cam 11 which is mounted to the driving shaft 1 and adjoins the outlet port 32, is rotated by an angle of 180° from the position shown in FIG. 4 and places the actuation rod 4 at the lowermost position, the upper semi-circular surface portion 421 which constitutes the inner surface of the actuation rod 4 which inner surface defines the tube inserting slot 42, and the upper half of the circumferential outer surface of the fixed shaft 2 are brought into close contact with each other, whereby the fluid chamber S is created again under the fixed shaft 2 in the tube 3.

Consequently, the fluid which is compressed while undergoing the above-described initial discharging procedure, is discharged out of the tube 3 through the fluid chamber S which is created under the fixed shaft 2 adjacent to the outlet port 32.

On the other hand, while the above descriptions have been provided with respect to the actuation rods 4 which are mounted to the tube 3 adjacent to the inlet port 31, the middle and the outlet port 32 of the tube 3, it is to be readily understood that, as shown in FIG. 1, other actuation rods 4 which are mounted to the tube 3 between the inlet port 31 and the middle of the tube 3 and between the middle of the tube 3 and the outlet port 32, are also repeatedly raised and lowered in such a way as to be interlocked with the driving shaft 1 and thereby, precision can be raised upon controlling fluid flow through the tube 3, whereby it is possible to provide a tube pump which can be reliably applied to the precision industry.

Moreover, while the above descriptions have been mainly provided with respect to fluid flow which is effected in the lower part of the tube 3 which lower part is defined under the fixed shaft 2, a person skilled in the art will readily recognize that fluid flow which is the same as that effected in the lower part, is also effected at the same time in the upper part of the tube 3. Therefore, a fluid flowing cross-sectional area at any point along the fixed shaft 2 over and under which upper and lower fluid chambers S are repeatedly created in the tube 3 in a manner such that the upper and lower fluid chambers S are partitioned from each other by the fixed shaft 2, is always held constant, whereby it is possible to prevent pulsation from being generated.

FIG. 6 is a side cross-sectional view illustrating a tube pump in accordance with another embodiment of the present invention. In the tube pump according to this embodiment of the present invention, the tube inserting slots 42 which are respectively formed at the lower portions of the actuation rods 4 in the above-described embodiment, are replaced with tube inserting holes 42' each of which has a circular cross-section, and a tube 6 having a circumferential outer surface which possesses a circular cross-section and an inner surface which defines a slot 61, is inserted through the tube inserting holes 42' of the actuation rods 4.

At this time, the inner surface of the tube 6 which inner surface defines the slot 61, comprises upper and lower semi-circular surface portions 611 and a pair of plane surface portions 612 which connect both ends of the upper and lower semi-circular surface portions 611, and the fixed shaft 2 always forces portions of the tube 6 inserted through the tube inserting holes 42' of the actuation rods 4, to be respectively brought into tight contact with portions of each actuation rod 4, at the pair of plane surface portions 612, whereby a space inside the tube 6 is divided into upper and lower space parts by the fixed shaft 2.

Also, it is to be readily understood that a distance L5 between centers of the upper and lower semi-circular surface portions 611 of the inner surface of the tube 6 which inner surface defines the slot 61, is determined to be smaller than two times of an eccentric distance L3 of each eccentric cam 11 in consideration of a percentage of contraction or expansion of the tube 6.

Accordingly, by altering only a cross-sectional shape of the tube from the circular hole to the slot 61, the same operations as in the above-described embodiment can be accomplished.

FIG. 7 is a side cross-sectional view illustrating a tube pump in accordance with still another embodiment of the present invention. In the tube pump according to the present invention, each actuation rod 4 has a cam mounting section 43 and a tube mounting section 44 which are connected with each other by a hinge member 45. The tube mounting section 44 of each actuation rod 4 is formed with a pair of plane surface portions 441, and a pair of vertical guides 46 are disposed at sides of the plane surface portions 441 of the actuation rods 4 to enable the tube mounting sections 44 of the actuation rods 4 to be raised and lowered along a vertical direction.

Hence, by enabling the tube mounting section 44 to be raised and lowered along the vertical direction, a lower part of the actuation rod 4 is prevented from fluctuating, whereby it is possible to secure operational stability.

Industrial Applicability

As a result, by the tube pump according to the present invention, advantages are provided in that, since the tube pump does not cause bending or folding of a tube when the tube pump is actuated, the tube is prevented from being ruptured, whereby it is possible to semi-permanently use the tube.

Moreover, because the tube which is inexpensive and has not so high flexibility and elasticity, is used, a manufacturing cost of the tube pump can be reduced.

Furthermore, due to the fact that a fluid flowing cross-sectional area at any point along a fixed shaft over and under which upper and lower fluid chambers are repeatedly created in the tube in a manner such that the upper and lower fluid chambers are partitioned from each other by the fixed shaft, is always held constant, pulsation is not generated, whereby it is possible to render a tube pump which can be reliably applied to the precision industry.

What is claimed is:

1. A tube pump comprising:

a driving shaft having a plurality of eccentric cams which are mounted to the driving shaft in a manner such that positions of top dead centers of the eccentric cams are sequentially lowered and then raised along a fluid flowing direction, the plurality of eccentric cams being spaced apart one from another by a predetermined distance;

a fixed shaft positioned parallel to the driving shaft;

a tube having an inner diameter which is larger than a diameter of the fixed shaft and surrounding the fixed shaft; and a plurality of actuation rods formed, at upper portions thereof, with a plurality of cam inserting holes into which the plurality of eccentric cams are respectively inserted and, at lower portions thereof, with a plurality of tube inserting slots through which the tube is inserted, the plurality of actuation rods being repeatedly raised and lowered in such a way as to be interlocked with rotation of the plurality of eccentric cams.

2. The tube pump as claimed in claim 1, wherein an inner surface of each actuation rod which inner surface defines the tube inserting slot, comprises upper and lower semi-circular surface portions and a pair of plane surface portions which connect both ends of the upper and lower semi-circular surface portions, and the fixed shaft always forces portions of the tube inserted through the tube inserting slot, to be respectively brought into tight contact with the pair of plane surface portions of the inner surface of each actuation rod, whereby a space inside the tube is divided into upper and lower space parts by the fixed shaft.

3. The tube pump as claimed in claim 1, wherein a distance between centers of the driving shaft and the fixed shaft is determined to be the same as that between centers of the cam inserting hole and the tube inserting slot, and a distance between centers of the upper and lower semi-circular surface portions of the inner surface of each actuation rod is determined to be smaller than two times of an eccentric distance of each eccentric cam in consideration of a percentage of contraction or expansion of the tube.

4. The tube pump as claimed in claim 1, wherein a bearing is intervened between a circumferential outer surface of the eccentric cam and a circumferential inner surface of each actuation rod, which defines the cam inserting hole, to reduce friction therebetween.

5. The tube pump as claimed in claim 1, wherein the tube inserting slots of the actuation rods are formed as circular tube inserting holes, and a tube having a circumferential outer surface which possesses a circular cross-section and an inner surface which defines a slot, is inserted through the circular tube inserting holes of the actuation rods.

6. The tube pump as claimed in claim 5, wherein the inner surface of the tube which inner surface defines the slot, comprises upper and lower semi-circular surface portions and a pair of plane surface portions which connect both ends of the upper and lower semi-circular surface portions, and the fixed shaft always forces portions of the tube inserted through the circular tube inserting holes of the actuation rods, to be respectively brought into tight contact with portions of each actuation rod, at the pair of plane surface portions, whereby a space inside the tube is divided into upper and lower space parts by the fixed shaft.

7. The tube pump as claimed in claim 1, wherein each actuation rod has a cam mounting section and a tube mounting section which are connected with each other by a hinge member, the tube mounting section of each actuation rod is formed with a pair of plane surface portions, and a pair of vertical guides are disposed at sides of the plane surface portions of the actuation rods to enable the tube mounting sections of the actuation rods to be raised and lowered along a vertical direction.

* * * * *